US006967190B1

(12) United States Patent
Narayanan et al.

(10) Patent No.: US 6,967,190 B1
(45) Date of Patent: Nov. 22, 2005

(54) STABLE WETTING CONCENTRATE

(75) Inventors: Kolazi S. Narayanan, Wayne, NJ (US); Jayanti Patel, Elmwood Park, NJ (US)

(73) Assignee: ISP Investments Inc., Wilmington, DE (US)

( * ) Notice: Subject to any disclaimer, the term of this patent is extended or adjusted under 35 U.S.C. 154(b) by 6 days.

(21) Appl. No.: 10/850,297

(22) Filed: May 20, 2004

(51) Int. Cl.[7] ..... C11D 1/02; C11D 1/72; C11D 3/28; C11D 7/32

(52) U.S. Cl. ..... 510/500; 510/189; 510/218; 510/241; 510/360; 510/413; 510/414; 510/421; 510/426; 510/433; 510/475; 510/492; 424/405; 504/116.1

(58) Field of Search ..... 510/189, 218, 510/241, 360, 413, 414, 421, 426, 433, 475, 510/492, 500; 424/405; 504/116.1

(56) References Cited

U.S. PATENT DOCUMENTS 6,239,089 B1 * 5/2001 Cala et al. ..... 510/175
6,432,897 B1 * 8/2002 Cable ..... 510/182

* cited by examiner

*Primary Examiner*—Brian P. Mruk
(74) *Attorney, Agent, or Firm*—William J. Davis; Walter Katz

(57) ABSTRACT

A stable wetting concentrate includes octyl or dodecyl pyrrolidone, an ethoxylated alcohol, and a compatabilizing agent for dilution of the concentrate with water, suitably a polar material, such as an anionic emulsifier, or polyol, which prevents separation of the two base components in water, and, optionally, water, provides a stable wetting composition upon dilution with water, which exhibit superior wetting and spreading properties.

8 Claims, No Drawings

STABLE WETTING CONCENTRATE

BACKGROUND OF THE INVENTION

1. Field of the Invention

This invention relates to wetting agents, and, more particularly, to a stable wetting concentrate, and aqueous wetting compositions thereof, which exhibit superior wetting and spreading properties.

2. Description of the Prior Art

Kolazi S. Narayanan, in U.S. Pat. Nos. 5,424,072; 5,508,249; 5,470,508; and U.S. Pat. No. 5,409,639; has described the use of N-octyl pyrrolidone (Surfadone® LP 100) (International Specialty Products) in several applications, particularly for agricultural chemicals. N-octyl pyrrolidone (NOP) however, is costly compared to other surfactants.

Accordingly, it is an object of this invention to provide a stable, superior wetting agent with NOP at a reduced cost.

SUMMARY OF THE INVENTION

What is described herein is a wetting concentrate comprising, by wt., (a) 10-30% of an octyl or dodecyl pyrrolidone, (b) 50-90% of an ethoxylated alcohol, e.g. ethoxylated noninol, (c) 0.5-5% of a compatabilizer for (a) and (b) upon dilution with water, e.g. an anionic emulsifier, or polyol, and (d) 0-10% water.

In the preferred forms of the invention, (b) contains 2 or 3 EO units, the weight ratio of (a):(b) is about 80:20, (c) is sodium lauryl sulfate or sodium laureth sulfate, and (c) is about 2.5%. and (d) is about 1.5%.

A stable wetting composition includes the wettable concentrate and water of dilution, wherein the water of dilution, in parts concentrate to water of is 1:50 to 1:5000, preferably 1:1000 to 1:2000.

A typical use wetting formulation herein includes the wetting concentrate and water of dilution, which is useful, e.g. as an agricultural spray solution, a surface cleanser, a car wash or a fountain wash.

DETAILED DESCRIPTION OF THE INVENTION

N-octyl pyrrolidone (Agsol® Ex 8 or Surfadone® LP 100) is used commercially in several applications, either neat or in conjunction with other formulated compositions. The main advantage of N-octyl pyrrolidone is its high solvency for hydrophobic molecules. It can also form mixed micelles with several other surfactants, especially with anionic emulsifiers such as sodium lauryl sulfate (SLS) and sodium laureth sulfate. N-octyl pyrrolidone is unique in also being a surface active solvent and thus it can function as an interfacial solvent. This property is advantageous in many consumer formulations e.g. to control the release of organic fragrances and to provide additional wetting on surfaces in spray solutions.

The wetting concentrate of the invention includes (a) octyl or dodecyl pyrrolidone, (b) an ethoxylated alcohol, e.g. ethoxylated nonyl alcohol, (c) is a compatabilizer, preferably an anionic emulsifier, or polyol, and, optionally (d) water.

Preferably, in the wetting concentrate, (b) contains 2 or 3 EO units; the weight ratio of (a):(b) is about 80:20; and (c) is sodium lauryl sulfate or sodium laureth sulfate.

A stable wetting composition of the invention comprises the wetting concentrate and water of dilution, wherein the water of dilution ratio of concentrate to water is about 1:50 to 1:5000; preferably about 1:1000 to 1:2000.

Typical use formulations of the invention includes the wetting concentrate in an agricultural spray solution, a surface cleanser, a car wash or a fountain wash.

Use formulations of the invention can have wetting times <30 sec. and a spreading area on Parafilm® surfaces (hydrophobic surface) 6.25×that of water (20 microliter).

EXAMPLES

Materials Used

Sodium Laureth Sulfate, 2 EO, Purity 25.6%, Rhodapex® ES-2 [Rhodia Chemicals, NJ].

Sodium Laureth Sulfate, 3 EO, Purity 30%, Standapol® ES-3 [Stepan Chemicals, NJ].

Sodium Lauryl Sulfate 29% aqueous solution, [Rhodia].

N-(n-Octyl)-2-Pyrrolidone, Water, Purity >99.0%, Agsol® Ex 8 [International Specialty Products, Wayne, NJ].

Poly-(Oxy-1,2-ethanedlyl)-alpha-undecyl-omega 1-undecanol, 1-undecanol, (ethoxylated nonyl alcohol). Purity 84%. Tomadol® 1-3 [Tomah Reserve, Inc., Reserve, LA].

A) Preparation of Wetting Concentrates and Aqueous Diluted Solutions Thereof of Solutions and Serial Dilutions.

The wetting concentrates were prepared by weighing accurately the appropriate amounts of each ingredient to produce 100 g of stock solutions.

Table 1 below shows the invention ternary compositions containing Agsol® Ex 8, Tomodol® 1-3, aqueous sodium laureth sulfate 2 EO, and/or aqueous sodium laureth sulfate 3 EO. These compositions were prepared by adding increasing amounts (from 0-25%) of commercially available aqueous sodium laureth sulfate to the base mixture of Agsol® Ex 8 and Tomidol® 1-3 (20:80).

TABLE 1

| | Wetting Concentrates | | | |
|---|---|---|---|---|
| Ingredient | 1 [SW 1] | 2 [SW 2] | 3 (SW 3) | 4 (SW 4) |
| Agsol Ex 8 | 20 | 19 | 18.83 | 19.0 |
| Tomadol 1-3 | 80 | 76 | 75.31 | 76.0 |
| SLS (29%) | 0 | 5 | 0 | 0 |
| Rhodapex ES-2, 25.6% | 0 | 0 | 5.86 | |
| Standapol ES-3, 30% | 0 | 0 | 0 | 5.0 |
| Total | 100 | 100 | 100 | 100 |
| Agsol Ex 8 | 20 | 19 | 18.73 | 19.0 |
| Tomadol 1-3 | 80 | 76 | 75.31 | 76.0 |
| SLS (Solid) | 0 | 1.5 | 0 | 0 |
| Rhodapex ES-2 | 0 | 0 | 1.50 | 0 |
| Standapol ES-3 | 0 | 0 | 0 | 1.50 |
| Water | 0 | 3.5 | 4.46 | 3.50 |
| Total | 100 | 100 | 100 | 100 |

These stock solutions were used to prepare for serial dilutions as follows. SW 1 diluted with distilled water.

1) 1/100,10 g of Agsol EX 8 was diluted to 1000 g.

2) 1/500,100 g of Solution 1) was diluted to 500 g.

3) 1/1000, 50 g of Solution 1) was diluted to 500 g.

4) 1/2000, 25 g of Solution 1) was diluted to 500 g.

5) 1/5000, 50 g of Solution 2) was diluted to 500 g.

Similarly, the rest of the stock solutions at dilutions: 1/100,1/1000, 1/2000, and 1,5000 were prepared as above. All diluted solutions were used for the following tests.

B) Stability/separation on standing

C) Drave's wetting time

D) Spreading/area of droplets/area ratios

E) Foam properties

B) Stability/Separation on Standing 50 ml of each diluted solution was transferred to a Nessler color comparison tube and each solution was observed from time zero to 10 days. The results are shown in Table 2 below.

C) Wetting Time (Drave's Method)

About 300 ml of each dilution (higher dilution first) was transferred into a 250 ml volumetric cylinder. The weight was Hooked on to a cotton skein, then transferred into the cylinder slowly with weight at the lower end. Once the weight was placed at the bottom of the cylinder, a stop watch was started immediately, and the position of cotton skein was observed. The time was recorded when the cotton skein fell to the bottom of the cylinder. This procedure was repeated several times and an average of the wetting time for each solution was recorded. Typically reproducibility was within 10% of reported values, as shown in Table 3. The aqueous solutions of Agsol Ex 8 were acidified with conc HCI to pH ~1.2 to solubilize Agsol Ex 8. In all other compositions using Agsol Ex 8, no acid was added.

D) Spreading Efficacy

A fine-mm graph paper was inserted between two 12 inch×12 inch glass plates. 20 microliter of each solution was transferred on a para-film wax paper mounted on the glass plate. The time and diameter of each drop was immediately recorded by observing it through a magnifying glass with ~20× magnification. The diameter of the same drop was again measured after three minutes. This procedure was repeated at least three times for each drop. The average diameter after three minutes was recorded. Similarly the average diameter of a drop of distilled water was recorded after three minutes. The ratio of the square of the radius of each set of droplets and the radius of a water droplet was calculated as a measure of spreading efficacy, as shown in Table 4.

E) Foam

A 50 ml solution was accurately transferred into a 100 ml-measuring cylinder, stoppered, and the solution was inverted at a 180° angle 25 times. The volume height of the foam was recorded for fifteen minutes from time zero to a 1-minute interval and the foam volume height was recorded. This procedure then was repeated and an average of two readings for each minute was recorded in mm length. Similarly foam heights of all diluted stock solutions were measured (see Table 5 relative foam heights for compositions 6 and 7 or SW 1 and SW 2).

Table 2 shows the physical stability of selected compositions of Table 1 upon dilution with at ratios of 1/100, 1/500, 1/1000, and 1/2000. All compositions remained clear even after 10 days. However, on dilution in water, the base composition not containing any anionic surfactant (SW 1) separated into two phases within 24 h at 1/100 dilution. However, addition of 5% aqueous sodium laureth sulfate (either with 2 EO or with 3 EO) was sufficient to improve its stability on dilution.

The wetting, spreading and foaming properties of the blends of Agsol® Ex 8, Tomadol® 1-3 and aq Rhodapex® ES-2, or, and Standapol® ES-3, at dilutions at 1/100, 1/500, 1/1000, 1/2000, and 1/5000 were determined. The results are shown in Tables 3 through Tables 5.

TABLE 2

Stability of Diluted Compositions of Invention at Room Temperature

| | 1 (SW 1) | 2 (SW 2) | 3 (SW 3) | 4 (SW 4) |
|---|---|---|---|---|
| Time, Zero | | | | |
| Dilution | | | | |
| 1/100 | Cloudy, phase separation with time | Cloudy, no separation after 7 days | Cloudy phase | Cloudy phase |
| 1/500 | Thin emulsion separation with time | Cloudy, 2 mm cream after one week | Thin emulsion | Thin emulsion |
| 1/1000 | Thin emulsion, separation with time | Thin emulsion, no separation in 20 days | Clear | Thin emulsion |
| 1/2000 | Thin emulsion, separation with time | Clear | Clear | Clear |
| 1/5000 | Clear | Clear | Clear | Clear |
| 24 hrs | | | | |
| 1/100 | Two phases, 150 mm top clears in 10 inversions, Reappears in 3–4 hrs | Cloudy, no separation in 7 days | Cloudy phase | Cloudy phase |
| 1/500 | Thin emulsion, separation with time | Cloudy, 2 mm cream after one Week | Thin emulsion | Thin emulsion |
| 1/1000 | Thin emulsion, separation with time | Thin emulsion, no separation in 20 days | Clear | Clear |
| 1/2000 | Thin emulsion, separation with time | Clear | Clear | Clear |
| 1/5000 | Clear | Clear | Clear | Clear |
| 10 days | | | | |
| 1/100 | Two phases, 100 mm cream, clears in 10 inversions, Reappears after 3–4 hrs | 30 mm cream on top, reversible, clears in 10 inversions, reappears after 24 hrs | Cloudy phase, thin emulsion | Cloudy phase, thin emulsion |
| 1/500 | Two phases, 10 mm cream on top | 5 mm cream on top after one week | Clear | Thin emulsion |
| 1/1000 | Two phases, 5 mm cream on top | Clear to cloudy, 2 mm cream after 20 days | Clear | Clear |
| 1/2000 | Two phases, 2 mm cream on top | 2 mm cream after 20 days | Clear | Clear |
| 1/5000 | Clear | Clear | Clear | Clear |

TABLE 3

| Wetting Properties of Compositions of Invention | 1 [SW 1] | 2 [SW 2] | 3 (SW 3) | 4 (SW 4) |
|---|---|---|---|---|
| | Concentrate % Composition | | | |
| Agsol Ex 8 | 20 | 19 | 18.83 | 19.0 |
| Tomadol 1-3 | 80 | 76 | 75.31 | 76.0 |
| SLS (29%) | 0 | 5 | 0 | 0 |
| Aq. Rhodapex ES-2, 25.6% | 0 | 0 | 5.86 | 0 |
| Aq. Standapol ES-3, 30% | 0 | 0 | 0 | 5.0 |
| Dilution Ratio | Aqueous Use Formulation Wetting Time, sec | | | |
| 1/100 | 1 | 1 | 1–3 | 1–3 |
| 1/500 | 3 | 2 | 3 | 3 |
| 1/1000 | 9 | 6 | 10 | 10 |
| 1/2000 | 22 | 24 | 20 | 23 |

TABLE 4

| Spreading Properties* | | | | |
|---|---|---|---|---|
| Dilution Ratio | 1 (SW 1) | 2 (SW 2) | 3 (SW 3) | 8 (SW 4) |
| 1/100 | 5.49 | 5.49 | 5.49 | 5.88 |
| 1/500 | 5.49 | 5.49 | 5.88 | 5.88 |
| 1/1000 | 5.49 | 5.13 | 4.42 | 4.67 |
| 1/2000 | 4.67 | 5.13 | 4.42 | 5.13 |
| 1/5000 | 4.67 | 5.13 | 4.09 | 4.09 |

*Water system- Spreading data: Spreading droplet area ratio on paraffin-area ratio of 20 microliter droplet on Parafilm compared to water

TABLE 5

| Foam Height, mm on Dilution of Concentrates | 1 (SW 1) | 2 (SW 2) | 3 (SW 3) | 8 (SW 4) |
|---|---|---|---|---|
| Formulation | | | | |
| Agsol Ex 8 | 20 | 19 | 18.83 | 19 |
| Tomadol 1-3 | 80 | 76 | 75.31 | 76 |
| SLS (29%) | 0 | 5 | 0 | 0 |
| Rhodapex ES-2, 25.6% | 0 | 0 | 5.86 | 0 |
| Standapol ES-3, 30% | 0 | 0 | 0 | 5 |
| Total | 100 | 100 | 100 | 100 |
| | after 1 min | 2 min | 3 min | 5 min |
| SW 1 — Dilution in deionized water | | | | |
| 1/100 | 67 | 57 | 38 | 19 |
| 1/500 | 44 | 29 | 19 | 13 |
| 1/1000 | 48 | 46 | 46 | 46 |
| 1/2000 | 42 | 36 | 29 | 23 |
| 1/5000 | 27 | 27 | 23 | 19 |
| SW 2 — Dilution in deionized water | | | | |
| 1/100 | 67 | 67 | 65 | 61 |
| 1/500 | 67 | 65 | 65 | 61 |
| 1/1000 | 57 | 51 | 51 | 49 |
| 1/2000 | 57 | 49 | 38 | 38 |
| 1/5000 | 48 | 34 | 32 | 28 |

TABLE 5-continued

| Foam Height, mm on Dilution of Concentrates | 1 (SW 1) | 2 (SW 2) | 3 (SW 3) | 8 (SW 4) |
|---|---|---|---|---|
| SW 3 — Dilution in deionized water | | | | |
| 1/100 | 66 | 66 | 65 | 65 |
| 1/500 | 66 | 66 | 65 | 65 |
| 1/1000 | 66 | 66 | 63 | 61 |
| 1/2000 | 47 | 47 | 45 | 45 |
| 1/5000 | 42 | 42 | 40 | 40 |
| SW 4 — Dilution in deionized water | | | | |
| 1/100 | 61 | 61 | 61 | 61 |
| 1/500 | 32 | 32 | 61 | 59 |
| 1/1000 | 28 | 28 | 53 | 51 |
| 1/2000 | 47 | 47 | 47 | 45 |
| 1/5000 | 40 | 40 | 40 | 40 |

Ternary blends of (N-octyl or N-dodecyl pyrrolidone), ethoxylated noninol with 2 EO and 3 EO and aqueous sodium lauryl sulfate or sodium laureth sulfate exhibited excellent properties of clarity, wetting, spreading, and foam on dilution with water. Superior wetting (cotton) and spreading on Parafilm® surfaces were observed with the blends. The most favorable clarity was observed for ternary blends, i.e. in the presence of an anionic emulsifier e.g. sodium laureth or sodium lauryl sulfates. The inventive compositions find application where wetting and spreading on hydrophobic surfaces is necessary, e.g. tank mix additives in agricultural formulations, and additives in cleaning compositions. Ternary blends with sodium laureth sulfate showed properties comparable to ternary blends with aqueous sodium lauryl sulfate; however sodium laureth sulfate is particularly advantageous for personal care products because of lower skin irritation of sodium laureth sulfate compared to sodium lauryl sulfate.

While the invention has been described with particular reference to certain embodiments thereof, it will be understood that changes and modifications may be made which are within the skill of the art. Accordingly, it is intended to be bound only by the following claims, in which:

What is claimed is:

1. A stable wetting concentrate comprising, by wt.,
(a) 10-30% octyl or dodecyl pyrrolidone,
(b) 50-90% of an ethoxylated alcohol,
(c) 0.5-5% of a compatabilizer for (a) and (b), and
(d) 0-10% water.

2. A stable wetting concentrate according to claim 1 wherein (b) is ethoxylated nonyl alcohol.

3. The wetting concentrate of claim 1 wherein (b) contains 2 or 3 EO units.

4. The wetting concentrate of claim 1 wherein the weight ratio of (a):(b) is about 80:20.

5. The wetting concentrate of claim 1 wherein (c) is sodium lauryl sulfate or sodium laureth sulfate.

6. The wetting concentrate of claim 1 wherein (c) is an anionic emulsifier.

7. A stable wetting concentrate of claim 1 wherein
(a) is 19%,
(b) is 76%,
(c) is 1.5, and
(d) is 3.5%.

8. The wetting concentrate of claim 1 wherein the concentrate is in the form of an agricultural spray solution, a surface cleanser, a car wash, or a fountain wash.

* * * * *